US006802244B1

(12) United States Patent
Stoppek et al.

(10) Patent No.: US 6,802,244 B1
(45) Date of Patent: Oct. 12, 2004

(54) HYDROSTATIC CYLINDER BLOCK AND METHOD OF MAKING THE SAME

(75) Inventors: Robert J. Stoppek, Mundelein, IL (US); David Dirks, Ames, IA (US); Robert J. Klinkel, Ames, IA (US)

(73) Assignee: Sauer-Danfoss, Inc., Ames, IA (US)

( * ) Notice: Subject to any disclaimer, the term of this patent is extended or adjusted under 35 U.S.C. 154(b) by 33 days.

(21) Appl. No.: 10/424,046

(22) Filed: Apr. 25, 2003

(51) Int. Cl.[7] ..... F01B 3/00
(52) U.S. Cl. ..... 92/71; 91/499; 29/888.02
(58) Field of Search ..... 92/71, 70, 57, 92/171.1; 91/499; 417/269; 29/888.061, 888.02

(56) References Cited

U.S. PATENT DOCUMENTS 3,460,481 A 8/1969 White, Jr.
3,622,254 A 11/1971 LeBlanc, Jr.
3,709,108 A * 1/1973 Alger et al. ..... 91/499
3,799,706 A 3/1974 Bilobran
3,955,475 A * 5/1976 Horiuchi et al. ..... 91/499
4,005,948 A * 2/1977 Hiraga et al. ..... 417/269
5,145,329 A 9/1992 Zumbusch et al.
5,581,881 A * 12/1996 Sherman et al. ..... 29/888.02
6,036,453 A 3/2000 Zepp et al.
6,094,815 A 8/2000 Shigihara et al.

FOREIGN PATENT DOCUMENTS

JP 358128488 A 8/1983

* cited by examiner

*Primary Examiner*—Edward K. Look
*Assistant Examiner*—Michael Leslie

(57) ABSTRACT

A method of making a cylinder block for a rotatable hydrostatic power member by separating the cylinder block into its four geometries and joining them together. The geometries include a base plate having a center opening and a arcuate kidney-shaped openings uniformly spaced radially around the center opening. The second geometrical item is a grooved drive shaft that fits into the center opening of the base plate. The third member is a group of tubular bore elements that fit in the base plate and mate with the drive shaft. The final member is a torque ring that matingly fits over the tubular piston bore elements.

6 Claims, 5 Drawing Sheets

HYDROSTATIC CYLINDER BLOCK AND METHOD OF MAKING THE SAME

BACKGROUND OF THE INVENTION

This invention relates to the method of making a hydrostatic cylinder block. More specifically, and without limitation, this invention relates to a method of breaking a hydrostatic cylinder block down into its basic geometries and parts to produce a new and more efficient hydrostatic cylinder block manufacturing process.

In general, most hydrostatic cylinder blocks that are used in medium and heavy duty applications are produced by machining a single piece of raw material into its final shape. This manufacturing process is not only expensive but limits the function and the dimensional capability of the design. The high manufacturing costs stem from the numerous processing steps, high capital investment, and ongoing production costs. Cylinder block concepts that completely rely on machining to obtain net shape impose design limitations because of the inability to properly machine due to geometric constraints, (i.e., honing of cylinder block bores cylindrically, surface finish, and machine bore undercuts) causing production to be difficult and expensive.

The current process for a heavy duty hydraulic cylinder block is performed in ten separate operations. The manufacturer must first rough the turn block and drill bores for the cast-on-bronze process. Then the manufacturer must cast bronze on the bottom of the cylinder block. Next, in two separate operations, a manufacturer must turn the overall shape of the block. The next step is to ream the bushing bores. After reaming the bushing bores, kidneys must be milled into the bushing bores. Then the manufacturer has to press bushings in the bores and finish the machine bushing bores. Finally, one must broach the block splines and lap the cylinder block face onto the block, thus creating the heavy duty hydrostatic cylinder block.

The complex geometries and functional requirements of a cylinder block have typically forced manufacturers to resort to a large number of manufacturing operations. In general, today's cylinder block designs limit manufacturing to processes that are both costly and inefficient. To overcome the obstacle of a ten step process, a new concept has been conceived that breaks a standard cylinder block into basic geometries (components) that can be manufactured cost efficiently through various near net shaping technologies.

Near net shape processing achieves the final dimensions of a desired shape with minimal machining. Examples of near net shape technologies include casting, stamping, injection molding, and sheet metal working. For instance, in an injection molding process a mold of the dimensions needed for the construction of a metal product is created. Liquid metal is then injected into the mold and after some processes is cooled to create a machine part. This is called near net shaping because during the process the metal or material being used changes size and shape slightly during the cooling process. Therefore, near net shaping is not always perfectly accurate; however, because of recent advances in the near net shaping art, near net shaping is now precise enough to create hydrostatic cylinder blocks components of desired tolerances.

When machining hydrostatic cylinder blocks the machinery used to machine the blocks becomes worn, making maintaining dimensional tolerances very difficult. This exact machining takes a lot of time and can be very damaging to tools. Therefore, a process that would limit the amount of machining preformed on the block would greatly increase accuracy of tolerances and lower manufacturing costs.

Thus, it is a primary object of the present invention to provide a method of making a hydrostatic cylinder block that improves upon the state of the art.

Another object of the present invention is to breakdown a standard hydrostatic cylinder block into basic geometries that can be cost efficiently manufactured through various near net shaping processes.

Yet another object of the present invention is to efficiently transfer load and torque through the assembly.

A further object to the present invention is to utilize either by metal or conventional tubing to form cylinder bores.

Yet another object of the present invention is to join technology by discharge resistance welding, specifically to join piston bores to a base plate and a drive shaft to the same base plate.

A further object of the present invention is the integration of a polygon drive spline into a compact package. Yet a further object of the present invention is to increase torque carry capacity.

A further object of the present invention is to allow a manufacturer to have the ability to fine grind piston bores—hone/super finish operation.

A final object of the present invention is to be able to cost effectively add bore undercuts to a hydrostatic cylinder block.

These and other objects, features, or advantages of the present invention will become apparent from the specification and claim.

SUMMARY OF THE INVENTION

This invention relates to a hydrostatic cylinder block created by breaking the block into four basic geometries: a base plate, a drive shaft, piston bores, and a torque ring. Each can be produced using near net shape technologies. This minimizes the amount of machining that needs to occur before the block is in working form. This concept eliminates many of the machine operations and increases design and manufacturing flexibility. By using the geometries, the ten step operation of hydrostatic cylinder block manufacturing is now broken down into a three step operation. First, a manufacturer must join the four components. Then a manufacturer must hone the cylinder block bores and lap the cylinder block face onto the block. Thus, a heavy duty hydrostatic cylinder block can now be manufactured more efficiently and more inexpensively.

The present invention also provides for a hydrostatic cylinder block created by the method described. The block has a base plate with a center opening and bores located radially around the center opening. Each bore has a kidney-shaped opening. The block also has a drive shaft adapter that has an end adapted to mate with the base plate and an internal spline exterior adapted to receive a plurality of cylindrical piston bores. The block also has a torque ring that has a plurality of elongated arcuate grooves on its inner surface that matingly engage the piston bores.

DETAILED DESCRIPTION OF THE PREFERRED EMBODIMENT

Figure 1:
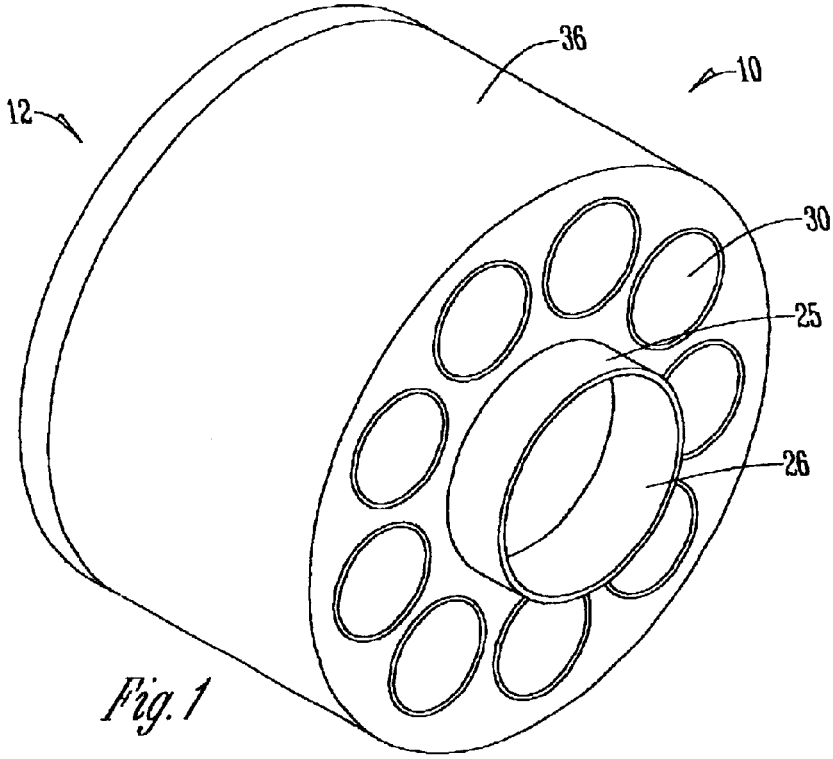
FIG. 1 is a top perspective view of the entire hydrostatic cylinder block.
Figure 2:
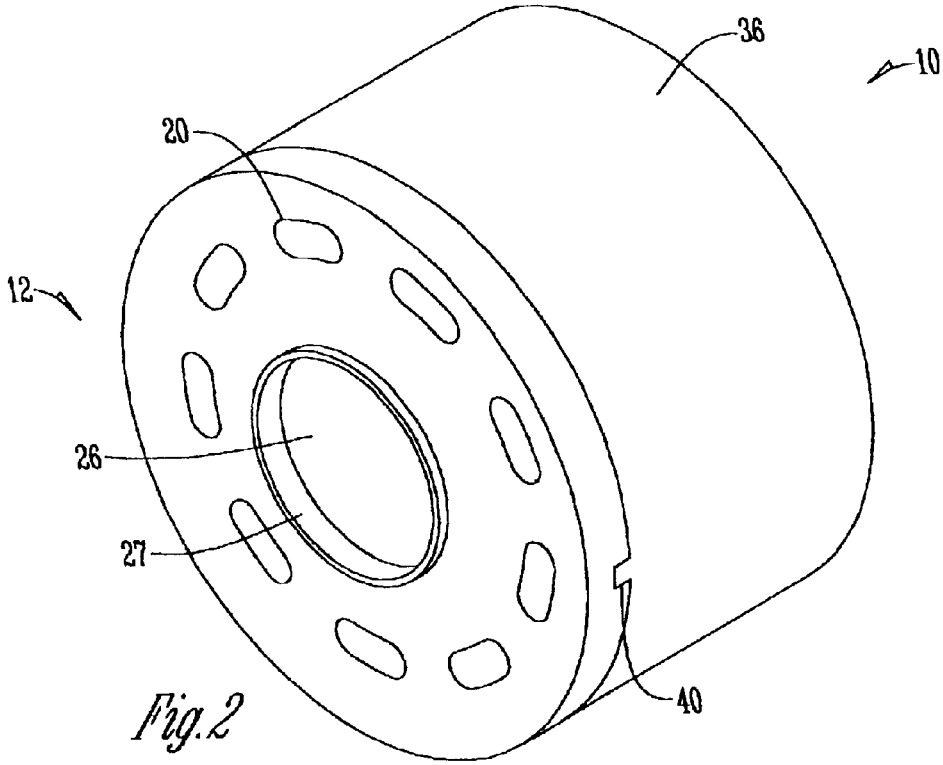
FIG. 2 is a bottom perspective view of the entire hydrostatic cylinder block.

FIGS. 1 and 2 show a top and bottom view of the hydrostatic cylinder blocks 10 of this invention. Hydrostatic cylinder blocks are generally used in applications where large amounts of torque are needed. Such applications include in farm equipment, such as tractors, and in lawn tractors.

Figure 3:
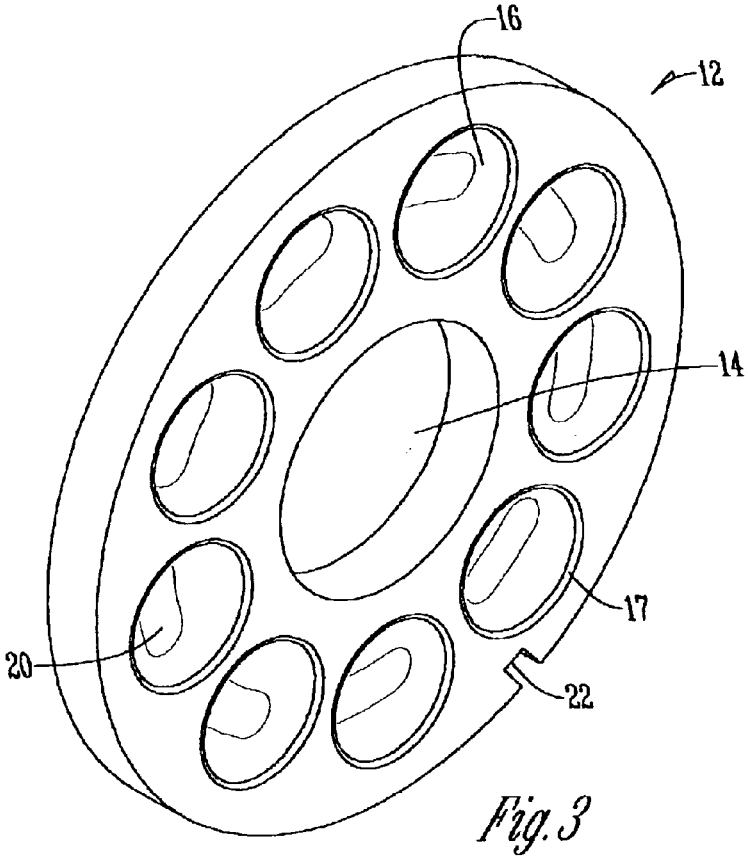
FIG. 3 is a perspective view of the base plate of the hydrostatic cylinder block.

The hydrostatic cylinder block 10 of the present invention is comprised of four separate components that can be seen in FIGS. 3–6. FIG. 3 shows a base plate 12. The base plate 12 is circular having a center opening 14 surrounded by a plurality of circular bores 16. An annular projection 17 resides at the face of each circular shaped bore 16 to facilitate the joining process between the base plate 12 and the piston bores 18. One method of joining the base plate 12 and the piston bore 18 is by resistance welding. The bores 16 also have kidney-shaped apertures 20 disposed through them. The perimeter of base plate 12 has a notch 22 located in it.

Figure 4:
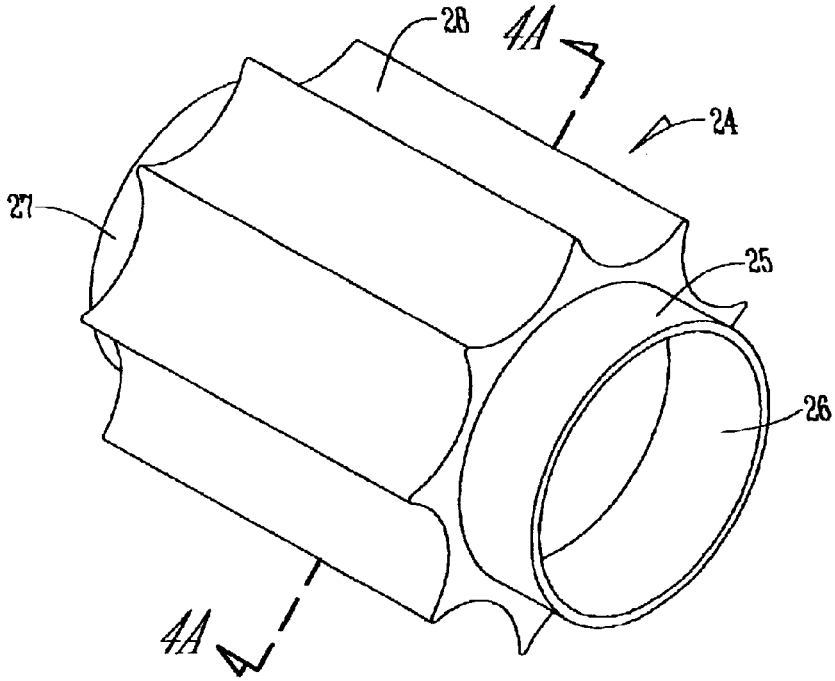
FIG. 4 is a perspective view of the drive shaft of the hydrostatic cylinder block.
Figure 4A:
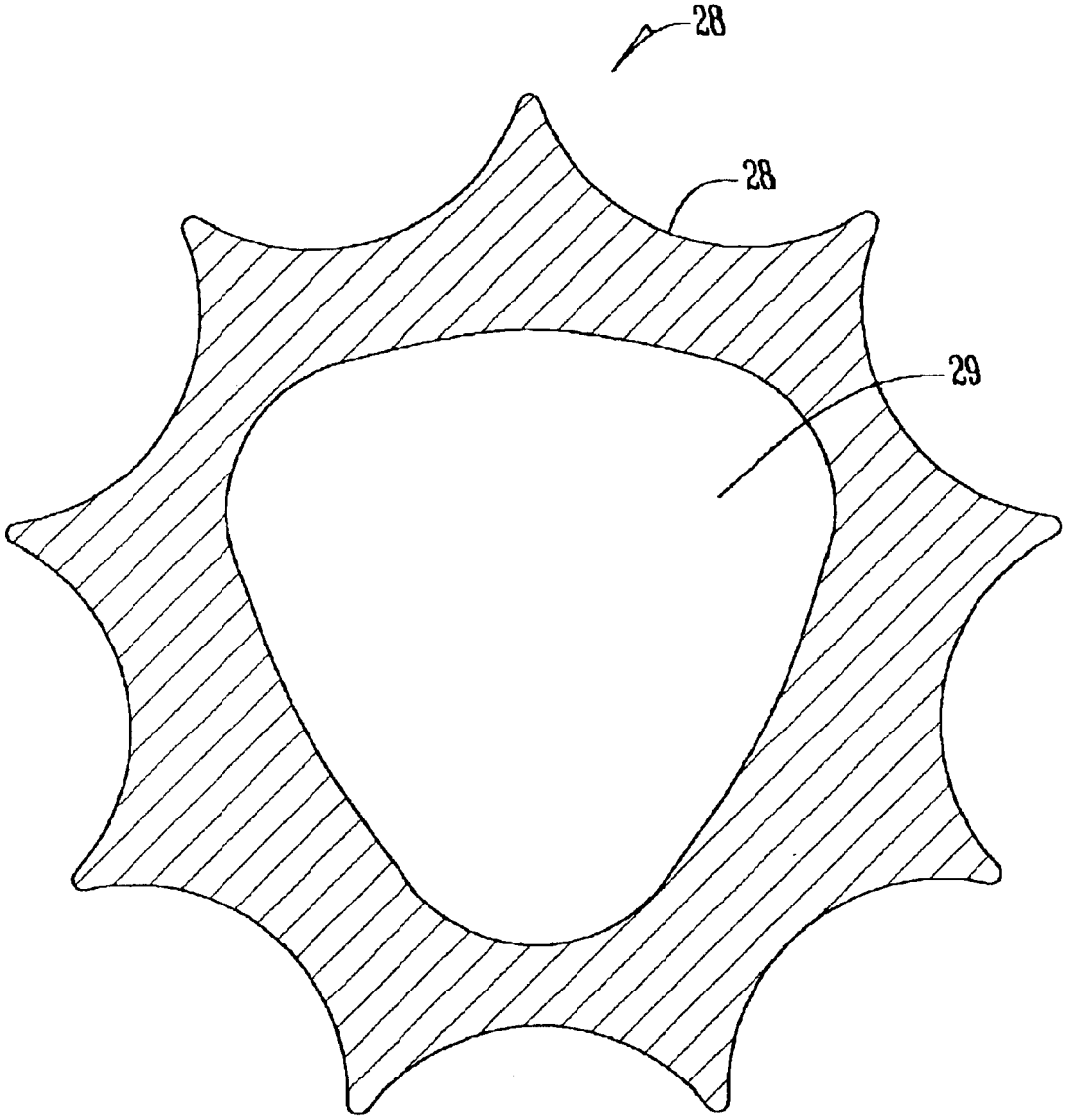
FIG. 4A is a sectional view of the drive shaft taken on line 4A—4A of FIG. 4.

FIGS. 4 and 4A show the drive shaft 24 of the hydrostatic cylinder block 10. Drive shaft 24 transmits torque between cylinder block 10 and the input/output shaft of the pump or motor (not shown). The drive shaft 24 has a front end hollow cylindrical member 25 that has a hollow interior 26. The drive shaft 24 connects to the base plate 12 via a back end connecting member 27, and has external splines 28 that slidably receive the piston bores 18. The splines 28 of the drive shaft 24 consist of a plurality of longitudinally extending semi-circular shaped grooves. As can be seen from a cross section of the splines 28 shown in FIG. 4A, in this embodiment the splines 28 have a polygon shaped hollow interior 29.

Figure 5:
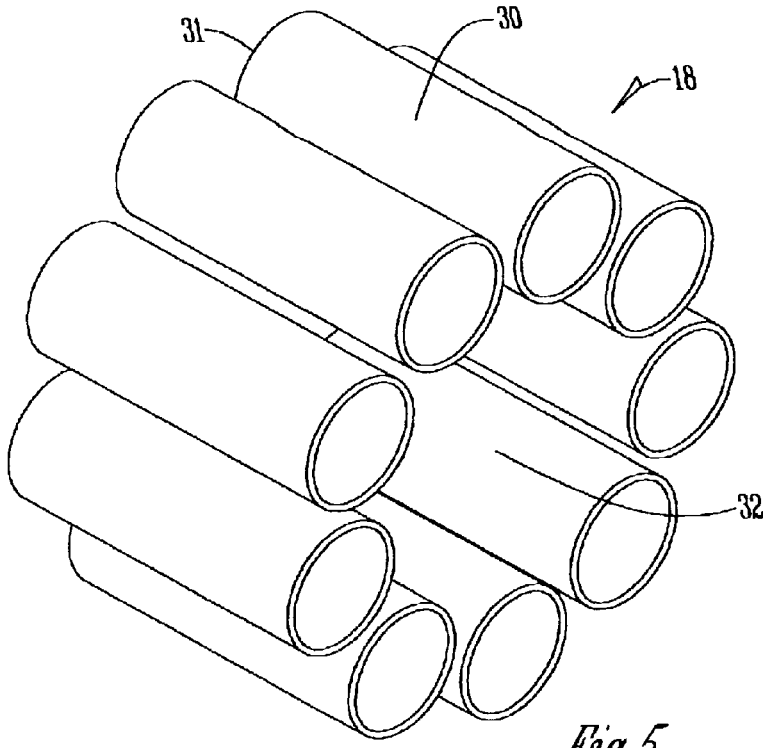
FIG. 5 is perspective view of the separate piston bores of the hydrostatic cylinder block clustered together as they will be in final assembly.

FIG. 5 shows the piston bores 18 of the hydrostatic cylinder block assembly 10. This block is comprised of a plurality of separate unconnected hollow elongated tube members 30 having rearward ends 32. When joined the tube members 30 are placed in the semi-circular grooves of the splines 28. The length of the tubing 30 will depend on the desired need of the manufacturer. The tubes 30 allow for a significant design in manufacturing flexibility. Depending on the requirements, the tubes 30 may either be manufactured from bi-metal tubing to accommodate heavy duty applications or standard steel tubing for medium duty. In addition, because the tubes 30 are open-ended, they can easily be modified to incorporate undercuts and honing operations.

Figure 6:
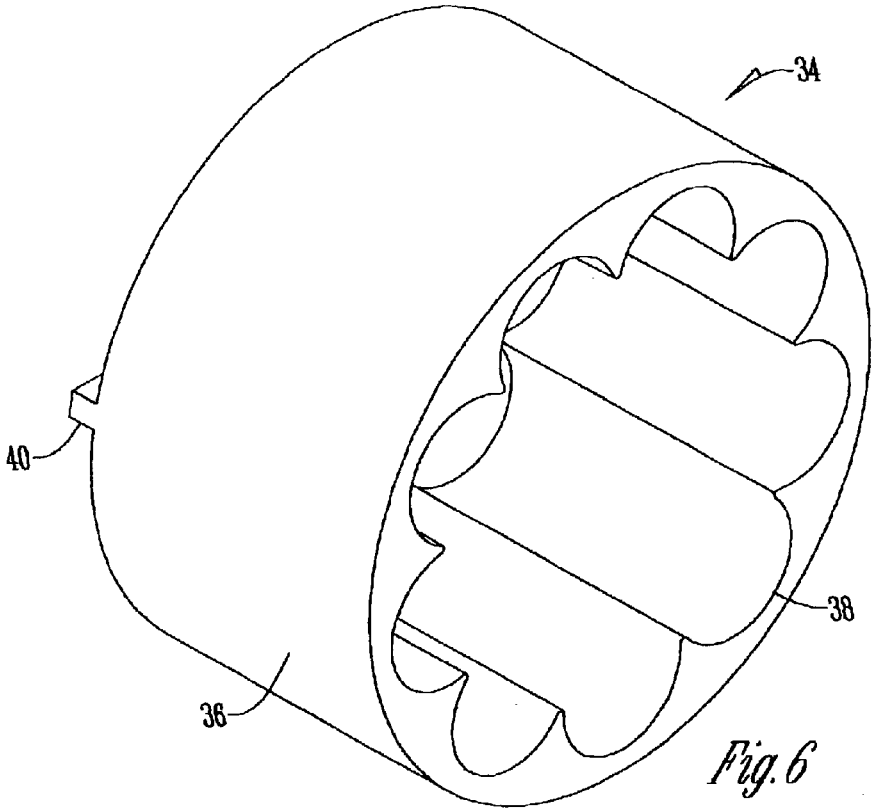
FIG. 6 is a perspective view of the torque ring of the hydrostatic cylinder block.

FIG. 6 shows the torque ring 34. Torque ring 34 has a circular sidewall 36 and elongated arcuate grooves 38 on its interior surface. The torque ring 34 also has a protrusion 40 on the circular sidewall 36. This protrusion can matingly fit into notch 22 of the base plate 12 ensuring a secure fit of the torque ring 34 to the base plate 12.

Figure 7:
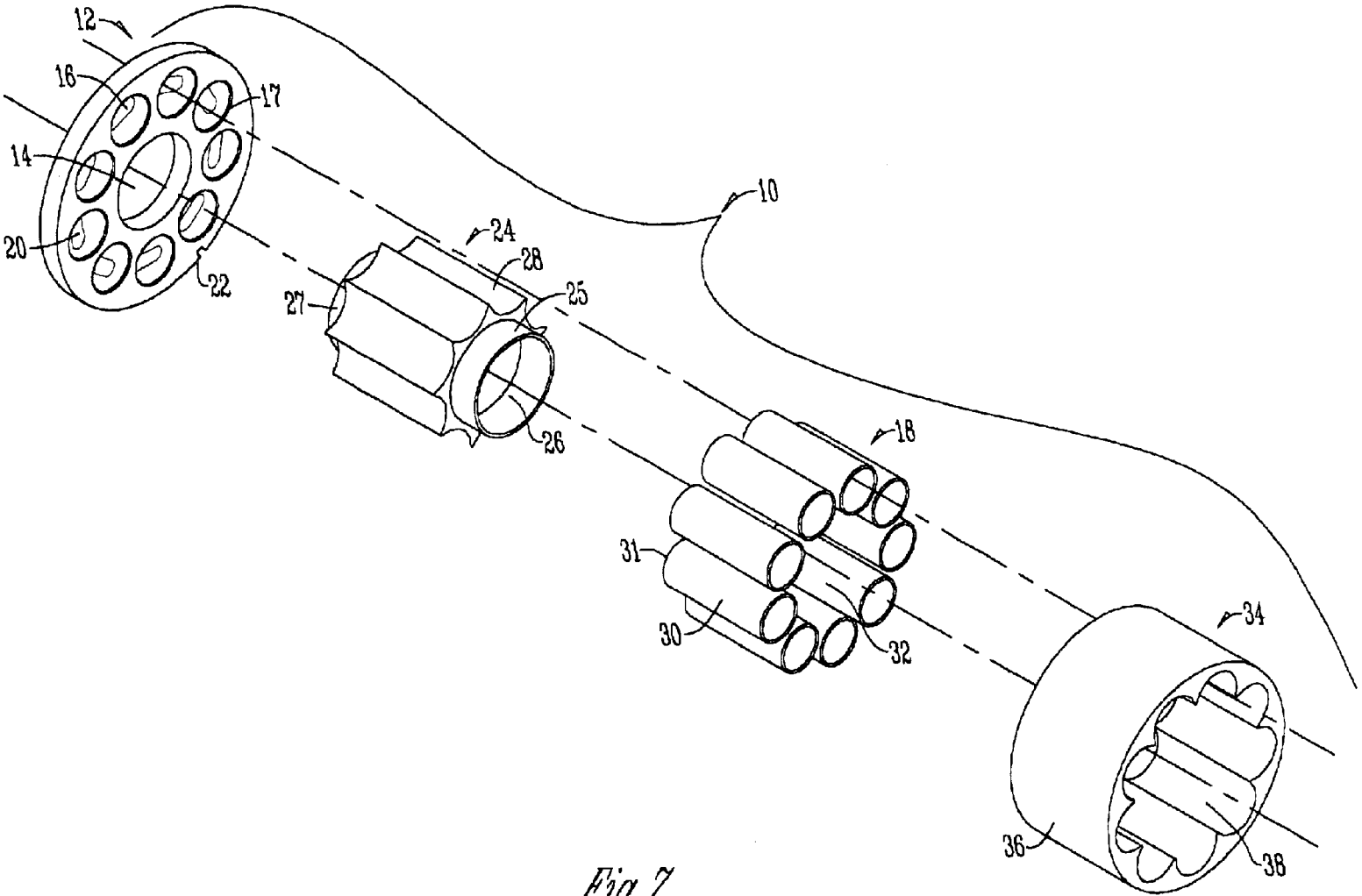
FIG. 7 is an exploded perspective view of the four parts separated with dashed lines showing how each part matingly fit together.

FIG. 7 shows how base plate 12, drive shaft 24, piston bores 18, and torque ring 34 matingly fit together to form the hydrostatic cylinder block assembly 10. The center aperture 14 of base plate 12 mates with the connecting member 27 of the drive shaft 24 and is welded thereto. The individual piston bores 18 are then placed over the top of the drive shaft 24 and welded onto base plate 12. Tube ends 31 are guided into bores 16 of base plate 12 by annular projections 17 and matingly fit into the bores 16. The tubes 30 also matingly rest in the semi-circular grooves of splines 28 of drive shaft 24. The drive shaft 24 connects in and radially aligns the bores 16 of the base plate 12 and piston bores 18. The center aperture 14 of the base plate 12 accommodates the drive shaft 24 through an interlocking connection (splines, flats, or tabs) or is resistance welded in place. Torque ring 34 slidably encompasses piston bores 18 and mounts onto base plate 12 in such a way that protrusion 40 matingly engages notch 22 to ensure accurate alignment of the components. When joined together the base plate 12, drive shaft 24, piston bores 18, and torque ring 34 form the hydrostatic cylinder block assembly 10 (FIGS. 1 and 2).

Therefore, in operation a hydrostatic cylinder block is created by merely placing the four components together and then honing the cylinder block bores and lapping the cylinder block face onto the hydrostatic cylinder block assembly. It should be appreciated that the base plate 12, the drive shaft 24, the piston bore members 18, and the cylindrical torque ring 34 in one embodiment can be fabricated so that their respective shapes and dimensions are cast by near net shape procedures to achieve their respective functions, eliminating separate machining operations to achieve the desired net shape. The individual components can then be joined by using discharge welding.

The described method will quickly and efficiently allow manufacturers to produce hydrostatic cylinder blocks using the geometries of the block's components. Therefore, this invention achieves all of its objectives.

It will be appreciated by those skilled in the art that other various modifications could be made to the device without departing from the spirit and scope of this invention. All such modifications and changes fall within the scope of the claims and are intended to be covered thereby.

What is claimed is:

1. A method of making a cylinder block for a rotatable hydrostatic power member, comprising, making a base plate having a center opening with arcuate kidney-shaped openings and uniformly spaced radially located bores arranged on opposite faces of the plate in registering positions, positioning a drive shaft adapter in the center opening of the base plate and connecting them together, placing a plurality of longitudinally extending semi-circular grooves in an outer surface of the drive shaft adapter to receive semi-circular portions of a plurality of cylindrical piston bore elements, forming a plurality of cylindrical piston bore elements in fixed relation to each other in parallel relationship with a center space among the bore elements having a diameter greater than the center opening of the drive shaft adapter, with the piston bore elements being of a size and position to be slidably inserted in mating relationship with the semi-circular grooves on the outer surface of the drive shaft adapter, slidably positioning the assembly of cylindrical piston bore elements into mating relationship with the semi-circular grooves on the outer surface of the drive shaft adapter, forming a cylindrical torque ring having a circular side wall with a plurality of elongated arcuate grooves on inner surfaces thereof of a size and shape to matingly engage external surface portions of the piston bore elements, slidably mounting the torque ring on the assembly of cylindrical bore elements to matingly engage external surface portions of the piston bore elements, to interlock the cylinder block together to insure the transfer of torque throughout the respective components.

2. The method of claim 1 wherein annular projections are formed around each bore to facilitate the joining of the base plate and the assembly of piston bore elements.

3. The method of claim 1 wherein the base plate, the drive shaft adapter, the assembly of piston bore elements, and the cylindrical torque ring are fabricated so that their respective shapes and dimensions are cast by near net shape procedures to achieve their respective functions so as to eliminate separate machining operations to achieve the desired net shape.

4. A hydrostatic cylinder block comprising:

a base plate having a center opening with arcuate kidney-shaped openings and uniformly spaced radially located bores arranged on opposite faces of the plate in registering positions;

a drive shaft adapter having a plurality of longitudinally extending semi-circular grooves in an outer surface and a first end matingly connected to the center opening of the base plate;

a plurality of cylindrical piston bore elements having peripheries that are received by the longitudinally extending semi-circular grooves;

said plurality of cylindrical piston bore elements also received by the uniformly spaced radially located bores;

a torque ring having a circular side wall with a plurality of elongated arcuate grooves on inner surfaces thereof of a size and shape to matingly engage external surface portions of the piston bore elements.

5. The hydrostatic cylinder block of claim 4 further comprised of annular projections that are formed around each base plate bore.

6. The hydrostatic cylinder block of claim 4 wherein the base plate, the drive shaft adapter, the assembly of piston bore elements, and the cylindrical torque ring are fabricated so that their respective shapes and dimensions are cast by near net shape procedures to achieve their respective functions so as to eliminate separate machining operations to achieve the desired net shape.

* * * * *